US006027118A

United States Patent [19]

Aramapakul et al.

[11] Patent Number: 6,027,118

[45] Date of Patent: Feb. 22, 2000

[54] METHOD OF PLAYING A BLACKJACK-TYPE GAME

[76] Inventors: Paiboon Aramapakul; Susan C. Travis, both of 2708 E. 15th St., Long Beach, Calif. 90804

[21] Appl. No.: 09/074,210

[22] Filed: May 7, 1998

Related U.S. Application Data

[63] Continuation-in-part of application No. 08/798,379, Feb. 7, 1997, abandoned.

[51] Int. Cl.[7] ..... A63F 1/00

[52] U.S. Cl. ..... 273/274; 273/292

[58] Field of Search ..... 273/274, 292

[56] References Cited

U.S. PATENT DOCUMENTS 5,366,228 11/1994 Kangsanaraks .
5,529,309 6/1996 Bartlett .
5,538,252 7/1996 Green .
5,549,300 8/1996 Sardarian .
5,645,281 7/1997 Hesse et al. .
5,735,524 4/1998 Wisted .

*Primary Examiner*—William M. Pierce
*Attorney, Agent, or Firm*—Ted Masters

[57] ABSTRACT

A method of playing a Blackjack-type wagering game (20) includes a player playing against a player-banker wherein the object of the game is to reach a numerical total of 20. The winner is (a) the player who has the largest numerical total which does not exceed 20, or if both player's exceed 20, (2) the player who's numerical total is closest to 20. A "natural" is defined as either two kings, two queens, two jacks, or two tens on the first two cards. In one embodiment, hands which exceed a numerical total of 20 are ranked by the high card which they contain, rather than by their proximity to 20. Game (20) can either be played as a banking or non-banking game.

2 Claims, 4 Drawing Sheets

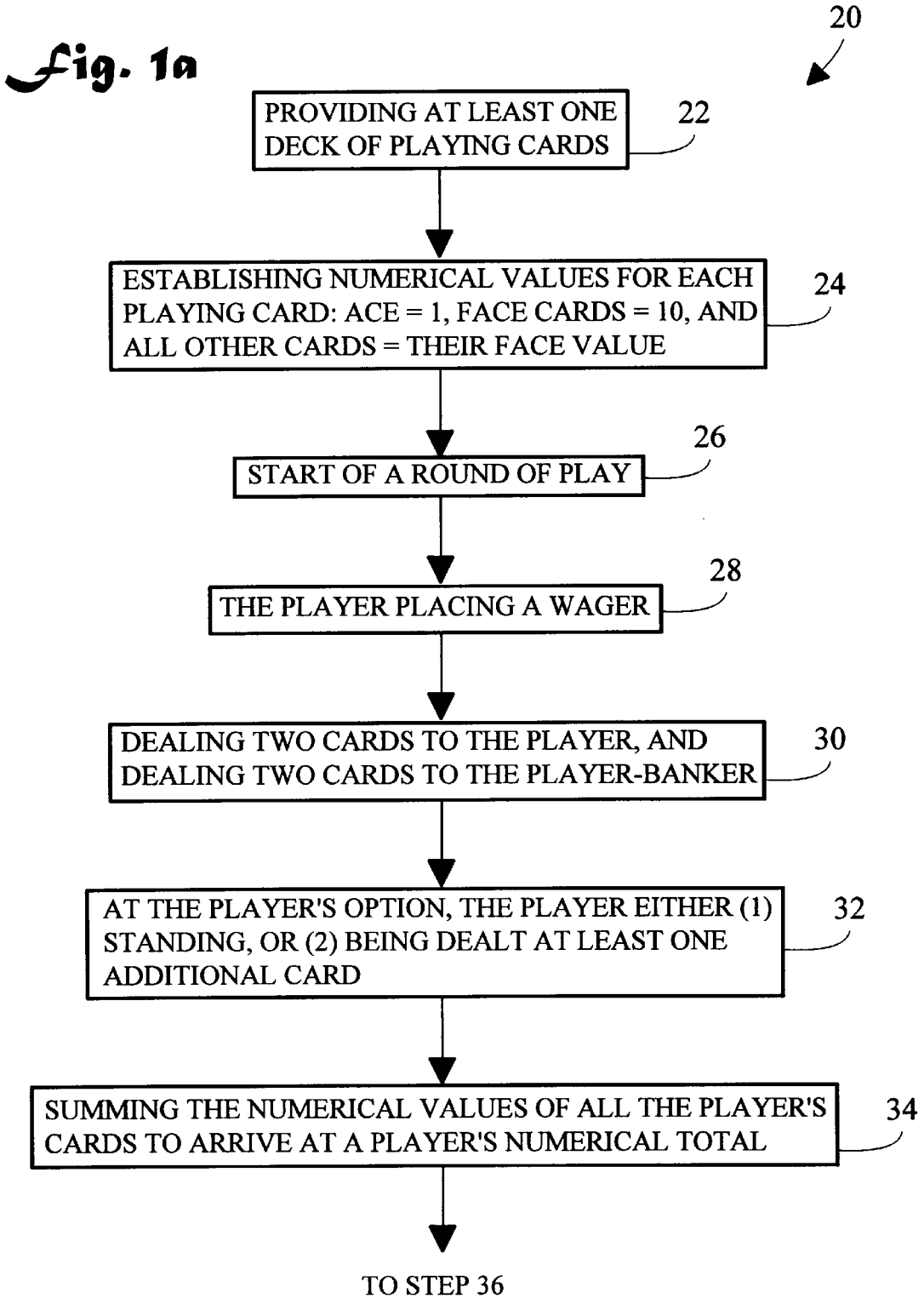
Fig. 1a
20
PROVIDING AT LEAST ONE DECK OF PLAYING CARDS
22
ESTABLISHING NUMERICAL VALUES FOR EACH PLAYING CARD: ACE = 1, FACE CARDS = 10, AND ALL OTHER CARDS = THEIR FACE VALUE
24
START OF A ROUND OF PLAY
26
THE PLAYER PLACING A WAGER
28
DEALING TWO CARDS TO THE PLAYER, AND DEALING TWO CARDS TO THE PLAYER-BANKER
30
AT THE PLAYER'S OPTION, THE PLAYER EITHER (1) STANDING, OR (2) BEING DEALT AT LEAST ONE ADDITIONAL CARD
32
SUMMING THE NUMERICAL VALUES OF ALL THE PLAYER'S CARDS TO ARRIVE AT A PLAYER'S NUMERICAL TOTAL
34
TO STEP 36

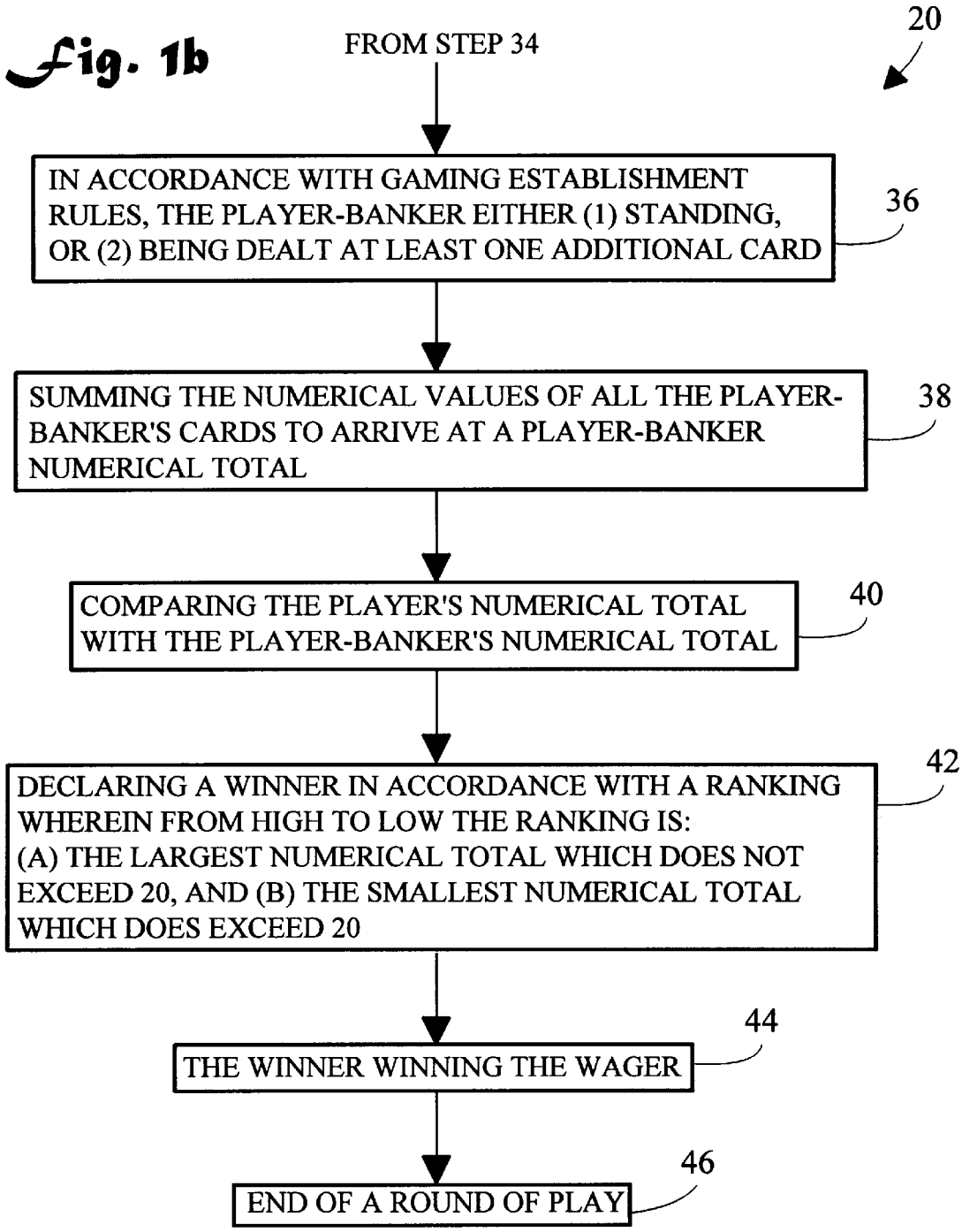
Fig. 1b
FROM STEP 34
20
IN ACCORDANCE WITH GAMING ESTABLISHMENT RULES, THE PLAYER-BANKER EITHER (1) STANDING, OR (2) BEING DEALT AT LEAST ONE ADDITIONAL CARD
36
SUMMING THE NUMERICAL VALUES OF ALL THE PLAYER-BANKER'S CARDS TO ARRIVE AT A PLAYER-BANKER NUMERICAL TOTAL
38
COMPARING THE PLAYER'S NUMERICAL TOTAL WITH THE PLAYER-BANKER'S NUMERICAL TOTAL
40
DECLARING A WINNER IN ACCORDANCE WITH A RANKING WHEREIN FROM HIGH TO LOW THE RANKING IS: (A) THE LARGEST NUMERICAL TOTAL WHICH DOES NOT EXCEED 20, AND (B) THE SMALLEST NUMERICAL TOTAL WHICH DOES EXCEED 20
42
THE WINNER WINNING THE WAGER
44
END OF A ROUND OF PLAY
46

METHOD OF PLAYING A BLACKJACK-TYPE GAME

CROSS REFERENCE TO RELATED APPLICATION

This application is a continuation-in-part of application Ser. No. 08/798,379, filed Feb. 7, 1997, now abandoned, the disclosure of which is included herein by reference.

TECHNICAL FIELD

The present invention pertains to card games in general, and in particular to card games of the Blackjack-type.

BACKGROUND ART

Games of the Blackjack-type are well known in the art. In these games the cards have established numerical values, such as ace equals one or eleven, face cards equal ten, and other cards equal to their face values (e.g. a two has a numerical value of two, a three has a numerical value of three, etc.). A player tries to reach an established target numerical total by sequentially accumulating cards and summing their numerical values. Two cards are initially dealt, and the player then has the option of either (1) "standing" with the two cards, or (2) requesting and being dealt one or more additional cards ("hits").

The most common form of these games is the game of "Blackjack" or "21" wherein the established target numerical total is 21. A player wins a wager if the numerical total of the player's cards is less than or equal to 21 and is closer to 21 than the numerical total of the dealer's cards. If the numerical total of the player's or dealer's cards exceed 21, the respective hand is a "bust", and loses to any hand having a numerical total of 21 or less.

In certain states, such as California, Blackjack is illegal. Therefore, other similar Blackjack-type games have been devised. One such game is "California Blackjack" (U.S. Pat. No. 5,275,415) wherein the established target numerical total is 22. A player tries to get closer to 22 than the dealer (usually a "player banker"). If the player's numerical total exceeds 22 the hand is not a bust. Other established target numerical totals are of course also possible. For example, in U.S. Pat. No. 5,549,300 the target numerical sum is 20. In fact, any target numerical sum that is consistent with the established numerical values of the cards may be used.

DISCLOSURE OF INVENTION

The present invention is directed to a method of playing a Blackjack-type game, wherein the object of the game is to achieve a numerical total of 20. A preferred name for the present invention is DOUBLE JACK 20: The game is played between a player, or group or players, and a player-bank (or dealer) much as is the conventional game of Blackjack. The present invention differs from Blackjack in that (1) that the present invention has a target numerical total of 20 vs. 21 for Blackjack and (2) hands totaling over 20 do not "bust" but are rather relegated to a lower ranking than hands totaling 20 or under. The present invention also eliminates the confusing and time consuming back and forth fashion of calculating the winner which is utilized in games such as California Blackjack. In a preferred embodiment of the present invention, an ace is only counted as one, not one or eleven. This simplifies and expedites play for beginning players. And, by virtue of having the lower target numerical value of 20, the present invention results in faster play since it does not take as many cards to reach the desired total. Finally, in one embodiment of the present invention a unique "high card" feature is utilized to determine a winner if both competing players exceed 20. On such occurrences, a hand having a king high is ranked highest, followed respectively by a hand having a queen high, a hand having a jack high, and a hand having a ten high. In this embodiment, it does not make any difference which hand is closer to 20.

In accordance with a preferred embodiment of the invention, a blackjack-type game is played between a player and a player-banker wherein the object of the game is to achieve a numerical total of 20. After the player and the player-banker have taken all the hits that they desire, the player's numerical total is compared with the player-banker's numerical total, and a winner is declared in accordance with a predetermined high to low ranking. In a preferred embodiment the predetermined high to low ranking is:

(a) the largest numerical total which does not exceed 20; and, (b) the smallest numerical total which does exceed 20.

In accordance with an important aspect of the invention, the high to low ranking is:

a numerical total of 20;
a numerical total of 19;
a numerical total of 18;
a numerical total of 17;
a numerical total of 16;
a numerical total of 15;
a numerical total of 14;
a numerical total of 13;
a numerical total of 12;
a numerical total of 11;
a numerical total of 10;
a numerical total of 9;
a numerical total of 8;
a numerical total of 7;
a numerical total of 6;
a numerical total of 5;
a numerical total of 4;
a numerical total of 3;
a numerical total of 2;
a numerical total of 21;
a numerical total of 22;
a numerical total of 23;
a numerical total of 24;
a numerical total of 25;
a numerical total of 26;
a numerical total of 27;
a numerical total of 28; and,
a numerical total of 29.

In accordance with an important feature of the invention, if the player's first two cards or the player-banker's first two cards are two kings, two queens, two jacks, or two tens, a natural is declared.

In accordance with another important feature of the invention, if the player's first two cards and the player-banker's first two cards both have a numerical total of 20, the ranking further includes:

two kings;
two queens;
two jacks;

two tens; and, any other two cards which sum to 20.

In accordance with an important aspect of the invention, the high to low ranking is:

(a) the largest numerical total which does not exceed 20;

(b) a numerical total exceeding 20 and including a king high;

(c) a numerical total exceeding 20 and including a queen high;

(d) a numerical total exceeding 20 and including a jack high; and, (e) a numerical total exceeding 20 and including a ten high.

In another preferred embodiment of the present invention, the game is played as a "non-bank" game. That is, instead of a player (or players) playing against a player-banker or house dealer, the players all play against each other with the winner winning the wagers of all the other players.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a flow diagram illustrating the steps and method of play of a wagering game in accordance with the present invention;

MODES FOR CARRYING OUT THE INVENTION

Figure 2:
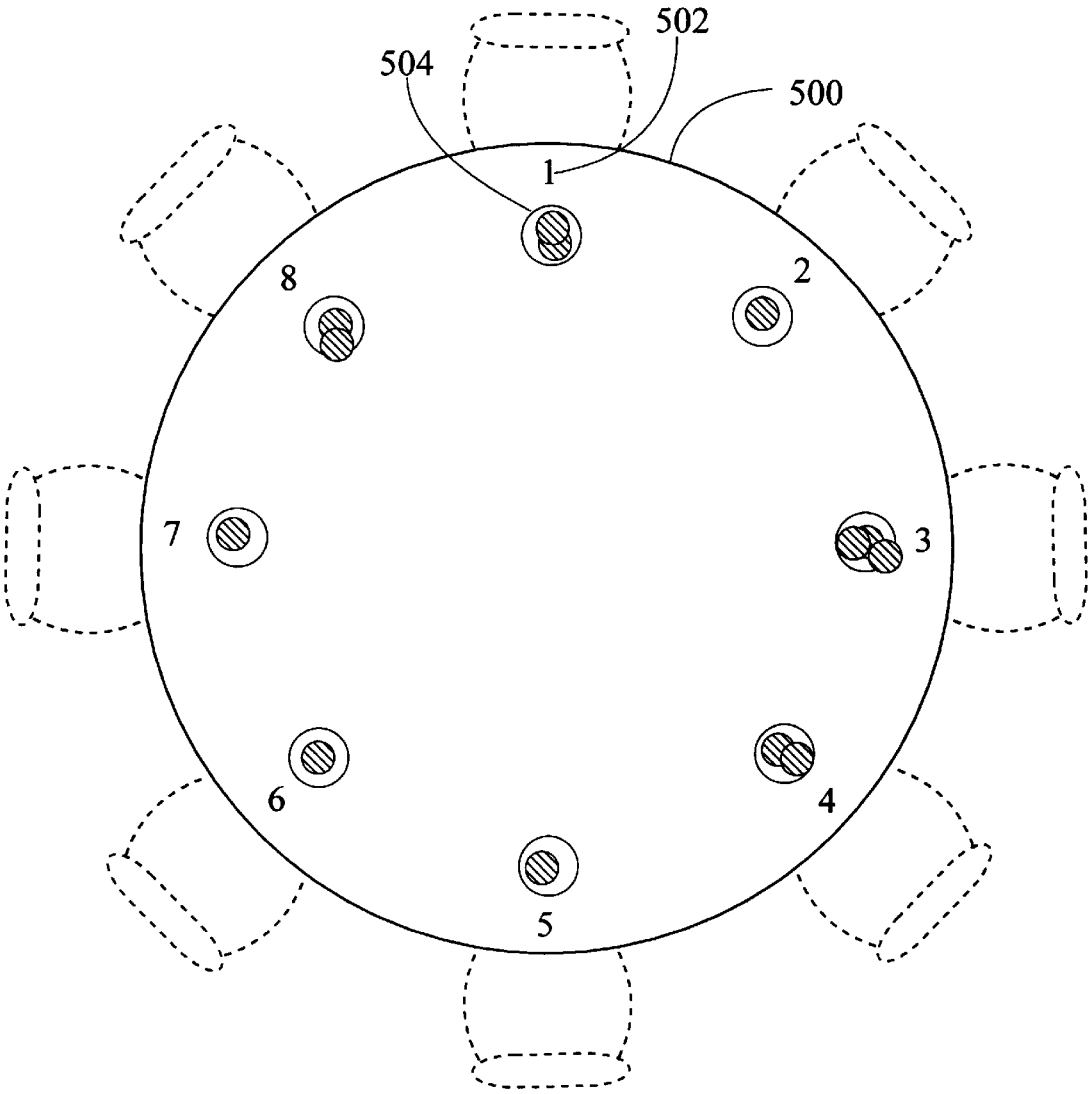
FIG. 2 is a plan view of a playing table layout.

Referring initially to FIG. 1, there is depicted a flow diagram illustrating the steps and method of play of a wagering game in accordance with the present invention, generally designated as 20. Game 20 comprises a Blackjack-type game wherein the object is to achieve or reach a numerical total of 20. Game 20 is played by a player (or by a plurality of players) who plays against a player-banker. Depending upon state and/or local laws, game 20 may also be played by a player who plays against a participating house dealer.

Game 20 begins with step 22 wherein at least one deck of playing cards is provided. In a preferred embodiment, the deck is a conventional deck of 52 cards. However, the deck could also be tailored to (1) add selected cards to the 52 cards such as one or more Jokers, (2) remove one or more selected cards from the 52 cards, or (3) any combination of (1) and (2). In step 24 numerical values are established for each playing card in the deck. The numerical values are: an ace equals one, face cards (king, queen, and jack) equal ten, and all other cards equal their face value. In an alternative embodiment, an ace may equal one or eleven.

A round of play of game 20 begins with start terminator step 26. In step 28 the player places a wager. In step 30 two cards are dealt to the player, and two cards are dealt to the player-banker. In step 32, the player has the option of either (1) standing (not taking any additional cards), or (2) requesting and being dealt one or more additional cards (hits). After the player has taken as many hits as desired, in step 34 the numerical values of all of the player's cards are summed to arrive at a player's numerical total. In actual play, the numerical values of the player's cards are sequentially summed beginning with the initial two cards, and as each additional card (hit) is received.

In accordance with gaming establishment rules, in step 36 the player-banker either (1) stands (does not take any additional cards), or (2) is dealt one or more additional cards. In one preferred playing embodiment of the present invention, the player-banker must hit if his/her numerical total is 15 or less, and must stand if his/her numerical total is 16 or greater. In step 38, the numerical values of all the player-banker's cards are summed to arrive at a player-banker's numerical total. In step 40, the player's numerical total is compared to the player-banker's numerical total. In step 42 the winner is declared according to a preestablished high to low ranking of numerical totals. In a preferred embodiment the ranking is:

(a) the largest numerical total which does not exceed 20; and, (b) the smallest numerical total which does exceed 20.

That is, in (a) if the numerical total of both persons does not exceed 20, the person who gets closest to 20 is declared the winner. In (b), a numerical total which exceeds 20 is not a "bust". If both the player and the player-banker exceed a numerical total of 20, the person having the numerical total which is closest to 20 is declared the winner. It is noted however that a numerical total which exceeds 20 loses to any numerical total which is less than or equal to 20. In a preferred embodiment, the specific ranking of numerical totals from high to low is:

a numerical total of 20;

a numerical total of 19;

a numerical total of 18;

a numerical total of 17;

a numerical total of 16;

a numerical total of 15;

a numerical total of 14;

a numerical total of 13;

a numerical total of 12;

a numerical total of 11;

a numerical total of 10;

a numerical total of 9;

a numerical total of 8;

a numerical total of 7;

a numerical total of 6;

a numerical total of 5;

a numerical total of 4;

a numerical total of 3 a numerical total of 2.

a numerical total of 21;

a numerical total of 22;

a numerical total of 23;

a numerical total of 24;

a numerical total of 25;

a numerical total of 26;

a numerical total of 27;

a numerical total of 28; and, a numerical total of 29.

It is noted that if the numerical total of the player's cards is less than or equal to 10, one additional card (hit) cannot result in a numerical total which exceeds 20. Therefore, in another preferred embodiment, numerical totals of between 10 and 2 are removed from the ranking.

In step 44 the winner, as determined by the ranking of step 42, wins the wager of step 28. In end terminator step 46, the round of play is ended.

If the player's first two cards and the player-banker's first two cards both have a numerical total of 20, the ranking further includes:

two kings;

two queens;

two jacks;

two tens; and, any other two cards which sum to 20.

For example, if the player has two queens (numerical total of 20) and the player-banker has two jacks (also a numerical total of 20), the player would be declared the winner. Also, if the first two cards are two kings, two queens, two jacks, or two tens, the hand is termed a "natural" (similar to an ace and a ten in Blackjack), and is declared an immediate winner. In a preferred embodiment, a natural pays 1.5 to 1.

In a second embodiment of game 20, numerical totals which exceed 20 are not ranked by their proximity to 20, but rather are ranked based upon the high card that they contain. A preferred ranking from high to low in this embodiment is:

(a) the largest numerical total which does not exceed 20;

(b) a numerical total exceeding 20 and including a king high;

(c) a numerical total exceeding 20 and including a queen high;

(d) a numerical total exceeding 20 and including a jack high;

(e) a numerical total exceeding 20 and including a ten high;

That is, in (a) if the numerical totals of both persons do not exceed 20, game 20 is played as previously described. However, if both persons exceed 20 it is not how close to 20 which determines the winner. Rather, it is the person who holds the higher ranking card who wins. For example, if the player's numerical total is 6+7+10 (a queen)=23, and the player-banker's numerical total is 9+3+10 (a jack)=22, the player wins by virtue of the fact that a queen out ranks a jack. In the previous embodiment, the player-banker would have won since 22 is closer to 20 than is 23. It may be appreciated that the card ranking could be comprised of other individual cards such as an ace or a joker, or other card combinations, and still be embraced by the principles of present invention. Also, it may be appreciated that the previously disclosed features of game 20 could also be applied to this embodiment.

In a third embodiment, game 20 is played as a "non-bank" game. That is, game 20 does not include a player-banker or a house dealer, but is rather played between a plurality of players who all play against each other. In this version, the player who has the highest ranking hand wins the wagers of all the other players. Two cards are initially dealt to each player. At each player's option, each player either (1) stands, or (2) is dealt at least one additional card. After each player has received all of the additional cards that he/she desires, the numerical values of each player's cards are summed to arrive at a numerical total for each player. The numerical totals of all the players are then compared, and a winner is declared in accordance with the following high to low ranking:

(a) the largest numerical total which does not exceed 20;

(b) the smallest numerical total which does exceed 20.

Again, it may be appreciated that the previously disclosed features of game 20 could also be applied to this embodiment. For example, if a player's first two cards are two kings, two queens, two jacks, or two tens, a natural is declared. And, if two or more players have a numerical total of 20 on the first two cards, two kings rank highest, followed by two queens, two jacks, and two tens.

Where legally permitted, game 20 can be player by a player against a participating house dealer. In a fourth embodiment of the present invention, numerical totals which exceed 20 are declared a "bust" and therefore lose to the other person. Again, it may be appreciated that the previously disclosed features of game 20 could also be applied to this embodiment.

If desired, game 20 can include certain of the playing features found in conventional Blackjack, such as splitting pairs and doubling down. Additionally, it may be appreciated that game 20 may be augmented with a variety of specially established rules of play as may be dictated by a particular gaming casino. Typical rules or game features might include, but are not limited to (1) the cards being dealt either face up or face down, (2) adding one or more Jokers to the deck, (3) playing with one deck or multiple decks, (4) adding or removing cards from the conventional 52 card deck, (5) the dealer or player-banker being required to stand or hit on certain numerical totals, and (6) any other special house rules deemed appropriate by the gaming establishment.

FIG. 2 is a plan view of a playing table layout. Playing table 500 includes a plurality of playing positions 502, eight in the shown embodiment. This playing table layout is most compatible when game (20) includes a plurality of players play against a player-banker. Indicia depicting a wagering area 504, playing positions 502, or other pertinent information can be disposed upon the surface of playing table 500 or a covering thereof. Wagering area 504 is used to place conventional wagers or bets/.

Figure 3:
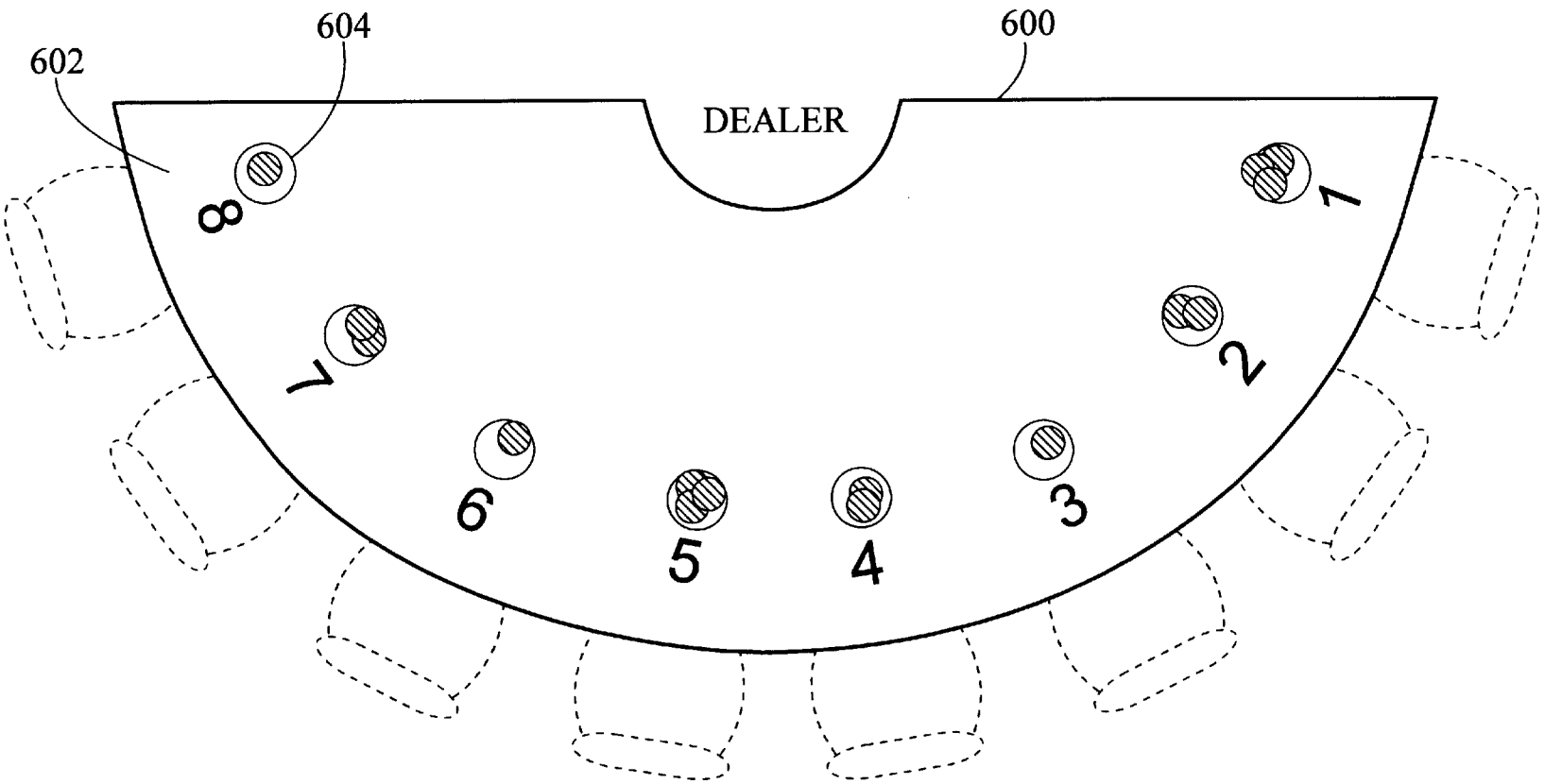
FIG. 3 is a plan view of a second playing table layout.

FIG. 3 is a plan view of a second playing table layout. Playing table 600 includes a plurality of playing positions 602, eight plus a dealer in the shown embodiment. This playing table layout is most compatible when game (2) includes a plurality of players play against a house dealer. Indicia depicting a wagering area 604, playing positions 602, or other pertinent information can be disposed upon the surface of playing table 600 or a covering thereof. Wagering area 604 is used to place conventional wagers or bets.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method of playing a blackjack-type game between a player and a player-banker wherein the object of the game is to achieve a numerical total of 20, comprising the steps of:

providing at least one deck of playing cards;

establishing numerical values for each card of said deck, the numerical values being:

ace equals one, face cards equal 10, and all other cards equaling their face value;

the player placing a wager;

dealing two cards to the player, and dealing two cards to the player-banker;

at the player's option, the player either (1) standing, or (2) being dealt at least one additional card;

summing the numerical values of the all the player's cards to arrive at a player's numerical total;

in accordance with gaming establishment rules, the player-banker either (1) standing, or (2) being dealt at least one additional card;

summing the numerical values of all the player-banker's cards to arrive at a player-banker's numerical total;

comparing said player's numerical total with said player-banker's numerical total;

declaring a winner in accordance with the following high to low ranking:

(a) the largest numerical total which does not exceed 20;

(b) the smallest numerical total which does exceed 20;

the winner winning said wager;

said high to low ranking including:

a numerical total of 20;
a numerical total of 19;
a numerical total of 18;
a numerical total of 17;
a numerical total of 16;
a numerical total of 15;
a numerical total of 14;
a numerical total of 13;
a numerical total of 12;
a numerical total of 11;
a numerical total of 10;
a numerical total of 9;
a numerical total of 8;
a numerical total of 7;
a numerical total of 6;
a numerical total of 5;
a numerical total of 4;
a numerical total of 3;
a numerical total of 2;
a numerical total of 21;
a numerical total of 22;
a numerical total of 23;
a numerical total of 24;
a numerical total of 25;
a numerical total of 26;
a numerical total of 27;
a numerical total of 28; and,
a numerical total of 29.

2. A method of playing a blackjack-type game between a player and a player-banker wherein the object of the game is to achieve a numerical total of 20, comprising the steps of:

providing at least one deck of playing cards;

establishing numerical values for each card of said deck, the numerical values being:

ace equals one, face cards equal 10, and all other cards equaling their face value;

the player placing a wager;

dealing two cards to the player, and dealing two cards to the player-banker;

at the player's option, the player either (1) standing, or (2) being dealt at least one additional card;

summing the numerical values of the all the player's cards to arrive at a player's numerical total;

in accordance with gaming establishment rules, the player-banker either (1) standing or (2) being dealt at least one additional card;

summing the numerical values of all the player-banker's cards to arrive at a player-banker's numerical total;

comparing said player's numerical total with said player-banker's numerical total;

declaring a winner in accordance with the following high to low ranking:

(a) the largest numerical total which does not exceed 20;

(b) the smallest numerical total which does exceed 20;

the winner winning said wager;

said high to low ranking including:

a numerical total of 20;
a numerical total of 19;
a numerical total of 18;
a numerical total of 17;
a numerical total of 16;
a numerical total of 15;
a numerical total of 14;
a numerical total of 13;
a numerical total of 12;
a numerical total of 11;
a numerical total of 21;
a numerical total of 22;
a numerical total of 23;
a numerical total of 24;
a numerical total of 25;
a numerical total of 26;
a numerical total of 27;
a numerical total of 28; and,
a numerical total of 29.

* * * * *